United States Patent [19]

Wu et al.

[11] 4,172,708

[45] Oct. 30, 1979

[54] PROCESS AND APPARATUS FOR USE WITH A REACTOR FOR THE PARTIAL COMBUSTION OF FINELY DIVIDED SOLID FUEL

[75] Inventors: Hsi L. Wu; Ian Poll; Hendrikus J. A. Hasenack, all of Amsterdam; Maarten J. van der Burgt, The Hague, all of Netherlands

[73] Assignee: Shell Internationale Research Maatschappij B.V., The Hague, Netherlands

[21] Appl. No.: 896,002

[22] Filed: Apr. 13, 1978

[30] Foreign Application Priority Data

Apr. 22, 1977 [NL] Netherlands ..... 7704399

[51] Int. Cl.[2] ..... C10J 3/82

[52] U.S. Cl. ..... 48/62 R; 34/13; 48/76; 48/87; 48/197 R; 55/83; 55/261; 261/79 A; 261/DIG. 54; 422/207

[58] Field of Search ..... 48/62 R, 87, 197 R, 48/206, 210, 180 M, DIG. 2, 76, 77; 110/264, 265, 229; 122/5; 23/277 C; 261/DIG. 54, 76, 79 A, 17; 55/83, 261; 34/13, 57 R; 422/207

[56] References Cited

U.S. PATENT DOCUMENTS

| | | | |
|---|---|---|---|
| 3,567,399 | 3/1971 | Altmann et al. | 23/277 C |
| 3,850,581 | 11/1974 | Hills et al. | 23/277 C |
| 3,930,802 | 1/1976 | Beasley et al. | 23/277 C |
| 4,054,424 | 10/1977 | Staudinger et al. | 48/197 R |

*Primary Examiner*—S. Leon Bashore
*Assistant Examiner*—George C. Yeung
*Attorney, Agent, or Firm*—Pravel, Gambrell, Hewitt, Kirk, Kimball & Dodge

[57] ABSTRACT

A process and apparatus, wherein as hot gas from a coal gasifier discharges through a tubular outlet having therein a wall which is permeable throughout its length for the flow of hot gas centrally therethrough, a gas shield is formed along the inner surface of the tubular outlet by passing a coolant through the wall, which gas shield cools the wall and prevents sticky ash particles in the hot gas from hitting the wall. The gas shield also cools the hot gas so that the sticky ash particles lose their stickiness.

12 Claims, 1 Drawing Figure

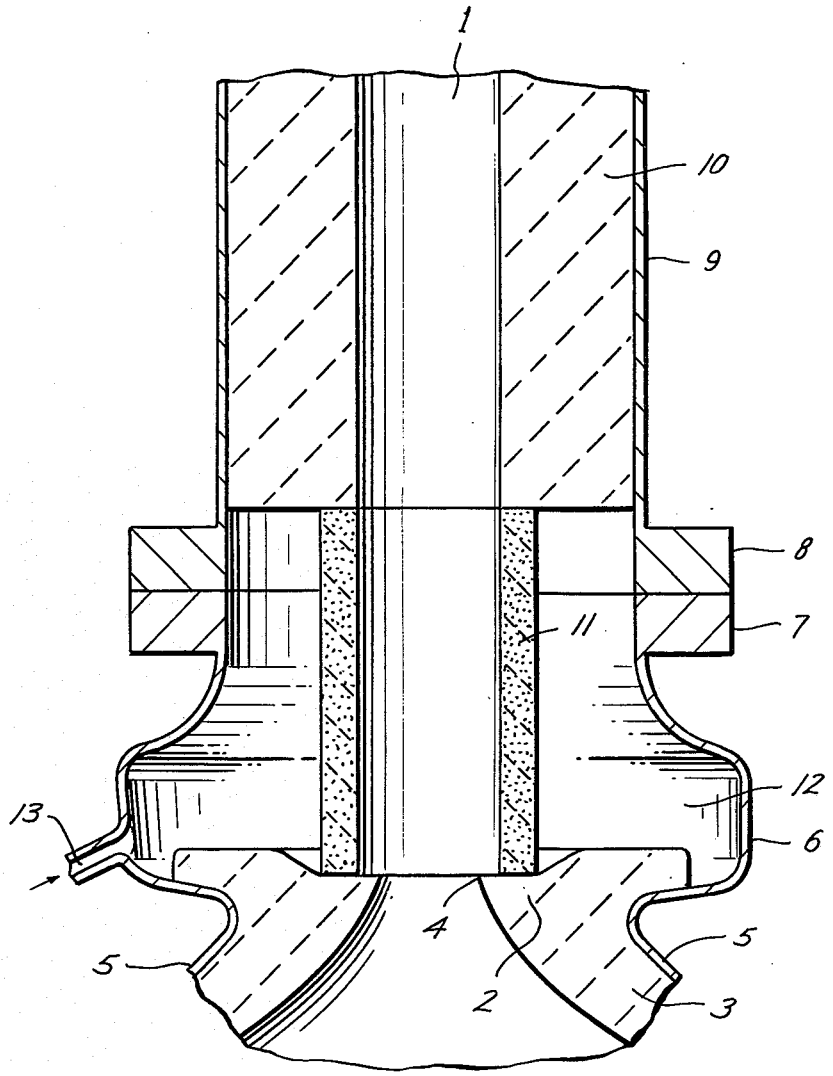
1
10
9
8
7
11
12
6
13
4
5
5
2
3

PROCESS AND APPARATUS FOR USE WITH A REACTOR FOR THE PARTIAL COMBUSTION OF FINELY DIVIDED SOLID FUEL

BACKGROUND OF THE INVENTION

In the partial combustion of solid fuel a hot product gas is discharged from the reactor which contains considerable percentages of hydrogen and carbon monoxide and which contains ash and char particles. Considerable amounts of water, carbon dioxide and/or nitrogen (the latter if air is used as gasifying agent) may be present in the product gas as well.

Partial combustion is the reaction of all of the fuel particles with a substoichiometrical amount of oxygen, either introduced in pure form or admixed with other gases, such as nitrogen or steam, whereby the fuel is partially oxidized to hydrogen and carbon monoxide. This partial combustion thus differs from complete combustion wherein the fuel is completely oxidized to carbon dioxide and water.

During discharge of the product gas, the problem arises that the sticky ash particles are deposited on the walls of the outlet duct, where they will solidify. The outlet duct may thus clog up, in which case the process must be interrupted—which is unacceptable.

Examples of fuels that raise specific problems solved by the present invention are coal, brown coal or lignite, heavy hydrocarbon residues, tar sands, shale oils and petroleum coke.

In an attempt to solve the foregoing problem, applicant previously proposed forming a gas shield to protect the wall of the outlet duct. The product gas could then be cooled in the outlet duct to such an extent as to cause the ash particles to solidify and lose their stickiness before they hit a wall. According to that proposal, the protective gas shield was introduced via an annular slit at the upstream end of the outlet duct.

In certain cases, however, a gas shield so formed may be disturbed prematurely. For instance, when a flexible coupling has been installed between the reactor and the outlet duct, a lateral displacement may occur between the nozzle with which the reactor opens into the outlet duct and the duct itself, which displacement would give rise to disrupture of the gas shield further upstream in the outlet duct. Again, when several burners are placed in the reactor opposite each other and when a minor change in the position of one or more burners occurs there is also a chance of "oblique" loading of the product gas outlet duct and local disturbance of the gas shield formed in the manner according to the earlier proposal. Besides, in low-capacity reactors, for instance, the degree of out-of-roundness and the surface roughness of the gas outlet duct are found to be critical factors, as well as growth of deposits on the wall and mutilation of the surface by the breaking out of chips during use (e.g., by damage due to thermal degradation of the wall material).

SUMMARY OF THE INVENTION

The invention relates to a process for the partial combustion of finely divided solid carbonaceous fuel containing at least 1% by weight ash in a reactor, product gas being discharged from the reactor via an outlet duct in which a protective gas shield is formed against the wall or walls that come into contact with the product gas.

The term "finely divided" as used herein is meant to denote smaller than 1 mm and "solid" is meant to denote solid at room temperature.

The invention is especially suitable in case the fuel contains ash-forming constituents which consist primarily of silicium oxides and/or aluminum oxides. At the temperature prevailing in the reactor, the ash is usually sticky. In particular, when the partial combustion takes place by entrained gasification in the flame, the residence time in the reactor is very short in comparison with gasification in a fluidized or moving bed and the temperature is very high.

The ash that forms during entrained gasification is at least partly in liquid form at the conditions that prevail in the reactor, usually temperatures above 1200° C.; e.g., 1400° to 1500° C. If the ash particles are not fully in the liquid form, they will generally consist at least partly of a molten slag or have a partly molten plastic constituency.

For entrained gasification it is much preferred that the fuel is divided as particles smaller than 1 mm in view of total gasification of all fuel in the short residence time.

The present invention provides a mode of discharge whereby early disturbance of the gas shield by "external" causes is prevented and which enables the gas shield to provide protection over a considerable length of the gas outlet duct and in a manner that is easier to control.

To this end, according to the invention, the said wall or walls are permeable and a gaseous coolant is passed through these walls into the outlet duct, where it forms the protective gas shield.

The term "permeable" as used herein is meant to denote that the wall will let the gaseous coolant through, e.g. by being porous or perforated or provided with openings in any other way.

This process has the advantage that a more stable gas shield develops as compared to the process earlier proposed, which results because with the present invention, the ash particles hit the wall further downstream in the outlet duct after the stickiness has been more completely eliminated.

The stability of the gas shield is less dependent upon external factors, such as the flow of the product gas than in the previous proposal. The optional introduction of additional coolant, e.g. further upstream than the permeable wall would influence the stability of the gas shield less than in the case of the prior proposal.

The gas shield has three main functions, i.e. to cool the product gas, to prevent ash particles from hitting the wall or walls and to cool those particles that yet pass through the gas shield before they do hit the wall or walls.

BRIEF DESCRIPTION OF THE DRAWING

The FIGURE of the drawing is a vertical sectional view of one embodiment of the apparatus of the present invention, used in carrying out the process of the present invention.

DESCRIPTION OF THE PREFERRED EMBODIMENT

In the FIGURE of the drawings, a suitable apparatus is illustrated for carrying out the process of this invention, wherein tubular outlet 1 links up via nozzle 2 with a reactor 3 for the partial combustion of coal powder. Only a small part of the top of the reactor 3 is shown in the FIGURE. The gas produced in the reactor 3 flows upwardly from the reactor 3 via nozzle 2 through outlet 1, which is only partially shown. The gas is discharged or is further conveyed from the upper end of the outlet 1.

The nozzle 2 has a constriction 4 whose diameter is smaller than the inner diameter of the tubular outlet 1. The nozzle 2 is made of refractory material so as to be resistant to the high temperature of the gas produced and is fitted inside a pressure-resistant reactor wall 5.

At the location of the nozzle 2, the reactor wall 5 is formed with a sleeve-shaped extension piece 6, open at the top and bounded at the open top by a flange 7. Mounted on the flange 7 by means of a flange 8 is a pressure-resistant outlet tube 9 lined with a thick layer of refractory material 10.

Inside the extension piece 6 there is a porous cylinder or cylindrical wall 11 whose inside diameter is equal to that of layer 10. The thickness of cylinder wall 11 is such that there is an empty space 12 around the cylindrical wall 11 which has a gas inlet 13. The cylindrical wall 11 is connected with the nozzle 2 at the bottom and with the layer 10 at the top by any suitable means.

The wall 11 may be porous or perforated, and the term "permeable" as used herein includes both. The passages through the wall 11 are substantially evenly distributed both longitudinally and laterally or circumferentially and in a direction substantially perpendicular to the length of the wall. A pattern of many passages is to be preferred. The porosity required limits the number of materials that are suitable, as do the requirements of thermal and mechanical strength.

Thus, for the porous wall 11, various materials are suitable, partly dependent on the type of coolant employed. The porous wall may, for instance, consist of sintered metal or froth metal or of ceramic or refractory material. In particular when liquid water is chosen as the coolant, it may be important to use different materials for the inside of the porous wall and for the outer layer, since the water will only evaporate near the inside of the wall and there the temperature gradient will be highest.

Preferred porosities for the wall are to be found in the range 0.05 to 0.5%. The velocity of the cooling gas while passing the permeable wall or walls will generally be between 0.1 and 10 meters/second (m/s).

Since the coolant is passed through the permeable wall 11, the pressure on the outside of that wall 11 will have to be higher than in the outlet duct 1 itself. Therefore, the permeable wall 11 is surrounded by the housing 9 for the supply of coolant to the permeable wall 11, which housing 9 must be able to stand up to this pressure. This is an advantage particularly in coal gasification at high pressure, because then the permeable wall, which is exposed to a high temperature, is not also subjected to a high pressure. The housing 9 may therefore be made of steel or a material that need not be heat-resistant, and the permeable wall of a material that need not be resistant to pressure. It will be clear, moreover, that the permeable wall is cooled in an efficient way by the gaseous coolant passing through.

An economic advantage of the mode of cooling according to the present invention is the fact that during cooling inside the permeable wall or walls 11, no heat is lost through radiation, etc. to the outside, since the coolant returns all heat to the product gas stream.

A yardstick for the effectiveness of the protective gas shield is the distance over which it is maintained in the outlet duct 1. This distance must be greater than the distance over which the ash particles continue to be sticky, the latter distance being partly dependent on the quantity and the initial temperature of the gas in the shield because of its cooling effect on the stream of product gas. It has been found that in the cooling process according to the earlier proposal there is an optimum in the above-mentioned effectiveness at a specific product gas/shielding gas ratio, which, naturally, does not contribute to the ease of control, and in certain cases, the optimum—i.e., the maximum attainable distance over which the gas shield remains intact—has been found to be smaller than the distance over which the ash particles retain their stickiness. An advantage of the process according to the present invention is that there is no such optimum, but that the effectiveness as defined above continues to increase with increasing shielding gas/product gas ratio.

It has further been found in practice that when an ash particle happens to penetrate through the protective gas shield the disturbance of the flow pattern in the outlet duct caused by the particle sticking against the wall is much more critical in the process according to the earlier proposal than in the one according to the present invention: in the former case the particle had a tendency to build up, in the latter case it has not. A conceivable explanation is that when the gas shield is created at the upstream end of the outlet duct, it is much more sensitive to surface roughness of the wall than when the gas shield is formed locally over the entire length of the outlet duct, which is what occurs according to the present invention.

According to preferred embodiment of the invention, recirculated product gas is used as the coolant, which product gas has previously been cooled and purified. Although other gaseous coolants, such as nitrogen, steam or carbon dioxide, may also be used, the use of product gas has the advantage that it is available and that it does not dilute the stream of product gas to be cooled.

According to the invention preferably 50 to 200% by weight of coolant, based on the weight of the product gas, is used.

According to the preferred embodiment of the invention, wherein a porous cylinder wall is used as the permeable wall 11, the length of this porous cylinder wall is between one-half and four times its diameter. If the porous cylinder wall is too short its effectiveness will be too low and the gas shield created will be broken up before the ash particles have been cooled down sufficiently. On the other hand, the porous cylinder wall need not be much longer than is necessary for creating a gas shield of sufficient length. But then, the length of the gas shield in the outlet duct may well extend beyond the end of the porous cylinder wall. The length of the porous cylinder wall will usually be chosen within the limits indicated.

In the embodiment with the porous cylinder wall, the product gas preferably flows from the reactor 3 into the bore of the porous cylinder wall 11 through the constriction 2 having a diameter of from 50 to 95% of the internal diameter of the bore of the porous cylinder wall 11. In this manner, the gas shield remains intact for the necessary length of flow through the outlet 1.

The apparatus depicted operates as follows in carrying out the process of this invention:

The hot product gas loaded with liquid ash particles flows upwardly through the nozzle 2 at a temperature of usually more than 1200° C. As a result of radiation from the reactor 3 and contact with the gas therefrom, the temperature of the nozzle 2 is so high that the ash particles precipitating on it remain liquid, and liquid ash drains back into the reactor 3.

The stream of ash-loaded product gas flows through constriction 4 into the inner bore of the porous cylinder wall 11.

Through inlet 13 a coolant, usually gaseous, is passed to the space 12 around the porous cylinder wall 11 under a pressure which is somewhat higher than that in the reactor 3 so that the coolant penetrates through the porous wall 11 and forms a protective gas shield within the bore of the cylinder 11 adjacent to its inner wall surface and surrounding the stream of product gas in the central portion of the cylinder wall 11. The stream of product gas in cylinder wall 11 will, over a certain distance, retain the diameter imposed by constriction 4, whereas the gas shield will hug the wall 11.

Depending on the factors mentioned heretofore, the gas shield will remain intact over a distance beyond the porous cylinder wall 11. The gaseous coolant cools the space 12, the porous wall 11 and the stream of product gas inside tubular outlet 1. After the product gas has travelled a certain distance through this outlet 1 the temperature of this gas will have decreased so much that the ash particles are not sticky any longer. The function of the gas shield, i.e., preventing the ash particles from hitting the wall of outlet 1, has then become superfluous, so that there is no need to maintain this gas shield beyond that point.

Especially for relatively small partial combustion reactors that are equipped with small-diameter outlet ducts, it will in many cases be preferred to discharge the product gas via one outlet duct that contains a porous cylinder wall. A relatively simple construction is thereby achieved as well as smooth product gas flow and a stable gas shield in the permeable wall. However, when dealing with larger reactors, more than one outlet might be useful or a large outlet containing more permeable walls, e.g. several tubular permeable walls in parallel or a number of flat permeable walls that are grouped together to form an octagonal tube or the like. The larger the cross section of the outlet duct is, the larger the ratio between volume and surface will be, so that sufficient cooling through a cylindrical permeable wall will then become less easily achievable.

The quantity of coolant that is required to form, according to the invention, a protective gas shield of sufficient length to cool the stream of product gas adequately, will in most cases lie within the aforementioned limits. It will be clear that the coolant/product gas weight ratio to be chosen will be partly dependent on the temperature of these two and, for instance, on the length of the permeable wall(s).

According to another embodiment of the invention, a gaseous coolant containing steam is used. The steam entering the product gas according to this embodiment may in some cases serve a useful purpose. When the product gas is used for the preparation of hydrogen or for the synthesis of hydrocarbons or base materials for the chemical industry, such as methanol, it is often necessary to increase the hydrogen content of the product gas. This is usually done by a catalytic conversion of carbon monoxide with steam. The presence of steam in the product gas according to the embodiment described just now may then be utilized. The steam may eventually be removed from the product gas by condensation and be recirculated.

The invention also includes a reactor for the partial combustion of solid fuel equipped with a tubular outlet for product gas with means to form a protective gas shield against the wall of the outlet, the outlet, according to the invention, comprising a permeable wall as well as means for passing a gaseous coolant through the permeable wall into the outlet.

The foregoing disclosure and description of the invention are illustrative and explanatory thereof, and various changes in the size, shape and materials as well as in the details of the illustrated construction may be made without departing from the spirit of the invention.

We claim:

1. A process for use at the outlet of product gas from a reactor wherein the partial combustion of finely divided solid carbonaceous fuel containing at least 1% by weight ash occurs, comprising the steps of:

providing within a tubular outlet having an inner surface a wall which is permeable throughout its length for the flow of product gas centrally therethrough, forming a protective gas shield against the inner surface of the outlet by passing a coolant through said wall to form the protective gas shield so that the length of the gas shield along the inner surface of the outlet is sufficient to cool the product gas to the point where the ash particles entrained therein are no longer sticky.

2. The process according to claim 1, wherein said coolant is recirculated, cooled and purified product gas.

3. The process according to claim 1, wherein the quantity of said coolant is from 50 to 200% by weight of the weight of said product gas from the reactor.

4. The process according to claim 1, 2 or 3, wherein the wall forms part of said outlet.

5. The process according to claim 1, 2 or 3, in which the length of the wall is between one-half and four times its diameter.

6. The process according to claim 5, wherein said product gas flows from the reactor into the wall through a constriction having a diameter of from 50 to 95% of the internal diameter of the wall.

7. The process according to claim 1, wherein the coolant comprises steam.

8. The process according to claim 1, wherein the porosity of the permeable wall is between 0.05 and 0.5% and the velocity of the gaseous coolant while passing the wall is between 0.1 and 10 meters/second.

9. An apparatus for mounting with a reactor for the partial combustion of solid fuel, comprising:

a tubular outlet having therein a wall which is permeable throughout its length for the flow of product gas centrally therethrough;

means to form a protective gas shield against the inner surface of the tubular outlet; and means for passing a coolant through the permeable wall to form the gas shield in the tubular outlet so that the length of the gas shield along the inner surface of the outlet is sufficient to cool the product gas to the point where the ash particles entrained therein are no longer sticky.

10. The apparatus of claim 9, wherein:

the permeable wall is a porous cylindrical wall.

11. The apparatus of claim 10, wherein:

the cylindrical wall is connected with the reactor via a constriction having a diameter which is 50 to 95% of the internal diameter of the cylindrical wall.

12. The apparatus of claim 10, wherein:

said cylindrical wall has a length between one-half and four times its diameter.

* * * * *